United States Patent [19]

Mikulesky

[11] 4,194,693

[45] Mar. 25, 1980

[54] LAWN SPRINKLER

[75] Inventor: Thomas L. Mikulesky, 6914 W. Palo Verde Dr., Glendale, Ariz. 85303

[73] Assignee: Penny R. Mikulesky, Glendale, Ariz.

[21] Appl. No.: 890,034

[22] Filed: Mar. 27, 1978

[51] Int. Cl.[2] ..... B05B 1/26

[52] U.S. Cl. ..... 239/390; 239/512; 239/DIG. 1

[58] Field of Search ..... 239/DIG. 1, 273, 275, 239/461, 507, 512, 524, 279, 222.11, 222.17, 276, 285, 287, 498, 518, 523, 390

[56] References Cited

U.S. PATENT DOCUMENTS

| | | | |
|---|---|---|---|
| 1,239,230 | 9/1917 | Shaw | 239/222.17 X |
| 1,931,689 | 10/1933 | Evans | 239/DIG. 1 |
| 2,007,675 | 7/1935 | Erickson et al. | 239/523 X |
| 2,027,567 | 1/1936 | Webb | 239/390 |
| 2,711,925 | 6/1955 | King | 239/390 |

FOREIGN PATENT DOCUMENTS

| | | |
|---|---|---|
| 1258983 | 3/1961 | France . |

*Primary Examiner*—John J. Love

*Attorney, Agent, or Firm*—Harry M. Weiss

[57] ABSTRACT

A lawn sprinkler adapted for unique water sprinkling areas which operates by impinging water upon one of a plurality of water distribution concavities. The plurality of water distribution concavities are of different shapes which may be selectively utilized for best distribution of water to the area to be watered.

7 Claims, 7 Drawing Figures

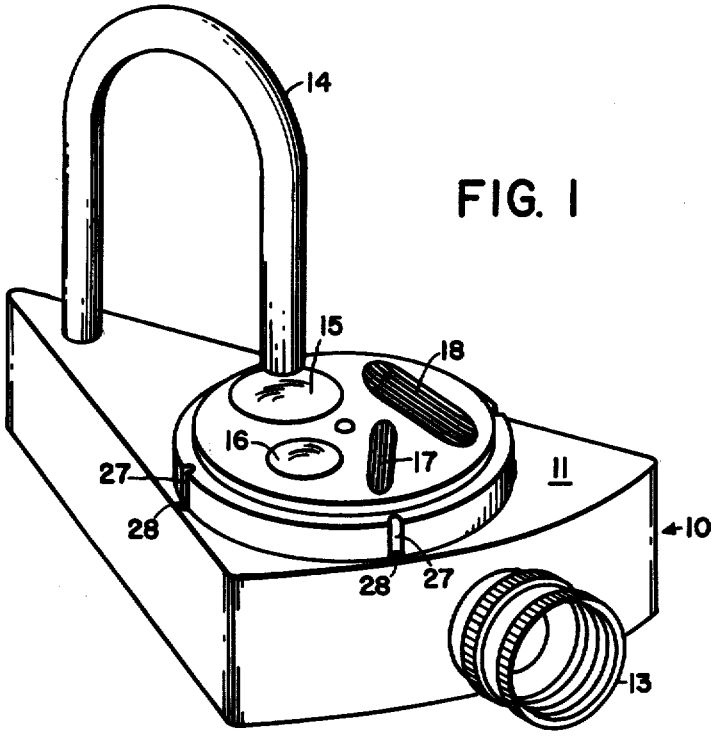
FIG. 1
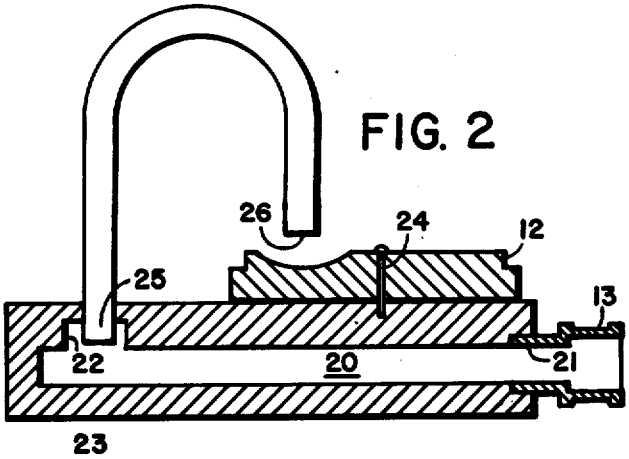
FIG. 2
FIG. 3a
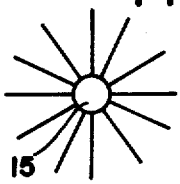
FIG. 3b
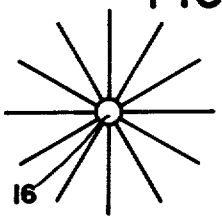
FIG. 3c
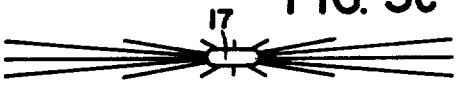
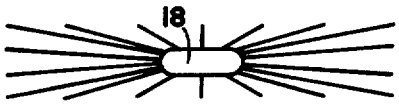
FIG. 3d
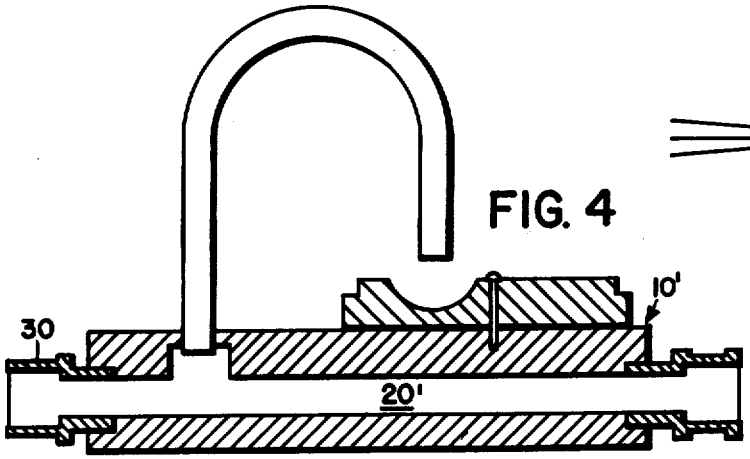
FIG. 4

LAWN SPRINKLER

BACKGROUND OF THE INVENTION

This invention relates to a lawn sprinkler and more particularly to a lawn sprinkler having selectable distribution patterns.

In the past, lawn sprinklers have been provided which provide water distribution in circular patterns or rectangular patterns. For example, a common type of lawn sprinkler is one which is rotatable about a vertical axis or shaft thereof having one or more spray nozzles. Such a sprinkler distributes the water in a circle or segment thereof. Another form of sprinkler has an oscillating or rotatable bar having spray openings along a length thereof. Such a sprinkler distributes the water in a generally rectangular pattern. Lawn sprinklers having no moving parts in operation have been provided with spray openings which allow only a circular or rectangular distribution.

SUMMARY OF THE INVENTION

It is an object of this invention to provide a lawn sprinkler having no operating parts which is selectable to provide different shaped distribution patterns.

It is an object of this invention to provide a lawn sprinkler which is selectable to provide both rectangular and circular distribution patterns.

A further object of the invention is to provide such a sprinkler which can be readily and economically produced.

In accordance with the foregoing objects, there is provided a lawn sprinkler including a base having a water conducting channel extending longitudinally therein. The channel has a water inlet means and a water outlet means and a water hose coupling engaged with the water inlet means. A water distribution plate is mounted on the top of said base and has a plurality of water distribution concavities in the upper surface thereof. Each of said concavities are of a different vertical and horizontal cross-section. The water distribution plate is mounted to said base by a shaft pin which extends through the plate and engages in the base. A water conduit is provided with a first end engaged with said water outlet means and a second end opening directly over one of the water distribution concavities whereby when water connection is made to the hose complex, water will flow through the channel and conduit, out the open end of the conduit and impinge on the one distribution concavity to be distributed on a lawn in accordance with the cross-sectional shape thereof. The distribution concavities are of a circular or oblong cross-section.

THE FIGURES

Further objects and advantages of the invention will be understood from the following complete description thereof and from the drawings herein:

FIG. 1 is an isometric view of a lawn sprinkler in accordance with the invention;

FIG. 2 is a vertical cross-sectional view thereof;

FIGS. 3 (*a*)-(*d*) are schematic views illustrating water distribution patterns thereof; and FIG. 4 is a vertical cross-sectional of another embodiment of the invention.

COMPLETE DESCRIPTION

As shown in FIG. 1, in accordance with the invention, a water sprinkler 10 includes a base 11 on which is mounted a water distribution plate 12. For economy of material the base 11 may be a pie-segment shape as shown. Engaged with the base 11 is a hose complex 13 and a water conduit 14. The water distribution plate includes a plurality (four being shown) of water distribution concavities 15, 16, 17 and 18 in the upper surface thereof.

As best seen in FIG. 2, the lawn sprinkler base 11 has a water conducting channel 20 extending longitudinally therein, the channel having water inlet means 21 and water outlet means 22. The water hose coupling 13 is engaged with the water inlet means 21. The base 11 has a bottom 23 adapted to rest on a lawn surface.

A water distribution plate 12 is mounted on the top of the base 11. The plurality of water distribution concavities 15–18 in the upper surface thereof are of a different vertical and horizontal cross-section and the water distribution plate 12 is mounted to said base by a shaft pin 24 which extends through the plate 12 and engages in the base 11.

The water conduit 14 has a first end 25 engaged with the water outlet means 22 and a second end 26 opening directly over one of the water distribution concavities 15–18. Thus, when water connection is made to the hose coupling 13, water will flow through the channel 26 and conduit 14, out the open end 26 of the conduit 14 and impinge on one of the distribution concavities 15–18 to be distributed on a lawn in accordance with the cross-sectional shape thereof.

The water outlet means 22 extends to the top of the base 11 whereat the conduit 14 engages therewith. Thus, the conduit 14 is of a generally inverted "J" shape whereby the conduit extends upwardly from the top, over, and downwardly to open over the distribution plate.

A lawn sprinkler is shown where the distribution concavities 15 and 16 are of a circular cross-section while the distribution concavities 17 and 18 are of an oblong cross-section.

As depicted in FIG. 3(*a*) and 3(*b*), the concavities 15 and 16 distribute the water in a circular pattern. Due to the difference in horizontal cross-section, the smaller concavity 16 will distribute the water at greater length than concavity 15 for a given amount of water impinging thereon. Similarly, as shown in FIG. 3(*c*) and 3(*d*), the concavities 17 and 18 distribute the water in generally rectangular patterns in accordance with the shapes thereof.

Referring back to FIG. 1, it should be noted that the distribution plate 12 is rotatable about the shaft pin 24 whereby said each of water distribution cavities may be positioned selectively under the open end of the water conduit. The plate 12 is provided with index notches 27 which engage with index projections 28 on the base to secure the plate 12 in the selected position.

As depicted in FIG. 4, a further embodiment of the invention includes a base which is provided with a second water coupling 30 engaged with the water conducting channel $20^1$ whereby lawn sprinklers may be connected in seriatim. The further parts of the sprinkler $10^1$ being the same has the same numbers.

Thus, it will be seen that there is provided a lawn sprinkler which is adapted for unique water sprinkling areas. While the invention has been disclosed by way of the preferred embodiments thereof, it will be appreciated that modifications may be made therein without departing from the spirit and scope of the invention.

What is claimed is:

1. A lawn sprinkler comprising:

a base having a water conducting channel extending longitudinally therein, said channel having water inlet means and water outlet means, a water hose coupling engaged with the water inlet means, said base having a top and bottom with the bottom adapted to rest on a lawn surface;

a water distribution plate mounted on the top of said base and having a plurality of water distribution concavities in the upper surface thereof with each of said concavities being of a different vertical and horizontal cross-section, said water distribution plate mounted to said base by a shaft pin which extends through the plate and engages in the base; and a water conduit having a first end engaged with said water outlet means and a second end opening directly over one of the water distribution concavities whereby when water connection is made to the hose coupling, water will flow through the channel and conduit, out the open end of the conduit and impinge on the one distribution concavity to be distributed on a lawn in accordance with the cross-sectional shape thereof.

2. A lawn sprinkler as recited in claim 1 wherein said distribution concavities are of a circular cross-section.

3. A lawn sprinkler as recited in claim 1 wherein said distribution concavities are of an oblong cross-section.

4. A lawn sprinkler as recited in claim 1 wherein said distribution plate is rotatable about said shaft pin whereby said each of water distribution cavities may be positioned selectively under the open end of the water conduit and the plate is provided with index notches which engage with index projections on the base to secure the plate in the selected position.

5. A lawn sprinkler as recited in claim 1 wherein said water outlet means extends to the top of the base whereat the conduit engages therewith, and the conduit being of a generally inverted "J" shape whereby the conduit extends upwardly from the top, over and downwardly to open over the distribution plate.

6. A lawn sprinkler as recited in claim 5 wherein said base is provided with a second hose coupling engaged with the water conducting channel whereby lawn sprinklers may be connected in seriatim.

7. A lawn sprinkler comprising:

a base having a water conducting channel extending longitudinally therein, said channel having water inlet means and water outlet means, said base having top and bottom portions;

separate selective water deflection means located on a plate rotatably mounted on said base for deflecting water in a selective pattern about said lawn sprinkler depending upon the position of said plate relative to said base; and a hollow water conduit having a first open end engaged with said water outlet means and a second open end opening in communication with said water deflection means whereby when water connection is made to said water inlet means water will flow through the channel and conduit, out the second open end of the conduit and impinge on said water deflection means to be distributed on a lawn in accordance with said pattern.

* * * * *